United States Patent [19]

Rich

[11] 4,114,764

[45] Sep. 19, 1978

[54] HANGER

[76] Inventor: Walter Rich, 1911 Spruce St., Philadelphia, Pa. 19103

[21] Appl. No.: 723,377

[22] Filed: Sep. 15, 1976

Related U.S. Application Data

[63] Continuation-in-part of Ser. No. 564,236, Apr. 2, 1975, Pat. No. 4,006,826.

[51] Int. Cl.[2] ..... A47F 5/08

[52] U.S. Cl. ..... 211/100; 211/171; 248/292; 211/101

[58] Field of Search ..... 211/96–101, 211/107–112, 170, 171, 1.3; 248/291–293

[56] References Cited

U.S. PATENT DOCUMENTS

| | | | |
|---|---|---|---|
| 2,875,903 | 3/1959 | Shourds | 211/100 |
| 2,895,702 | 7/1959 | Pierce | 248/293 |
| 3,096,063 | 7/1963 | Nygren | 248/292 |
| 4,006,826 | 2/1977 | Rich | 211/101 |

FOREIGN PATENT DOCUMENTS

| | | | |
|---|---|---|---|
| 568,414 | 6/1958 | Belgium | 211/100 |
| 1,187,722 | 9/1959 | France | 211/100 |
| 1,054,054 | 4/1959 | Fed. Rep. of Germany | 211/100 |

*Primary Examiner*—Roy D. Frazier
*Assistant Examiner*—Terrell P. Lewis
*Attorney, Agent, or Firm*—Seidel, Gonda & Goldhammer

[57] ABSTRACT

An improved hanger includes a hanger rail connected to mounting brackets by pivotable arms. A pull-down bar is pivotably connected to the hanger rail for pivoting the arms to thereby lower the hanger rail to an access position. Compression means in combination with limit stops maintain the hanger rail in a lower access position and also bias the hanger rail to an upper storage position.

6 Claims, 10 Drawing Figures

FIG. 1A
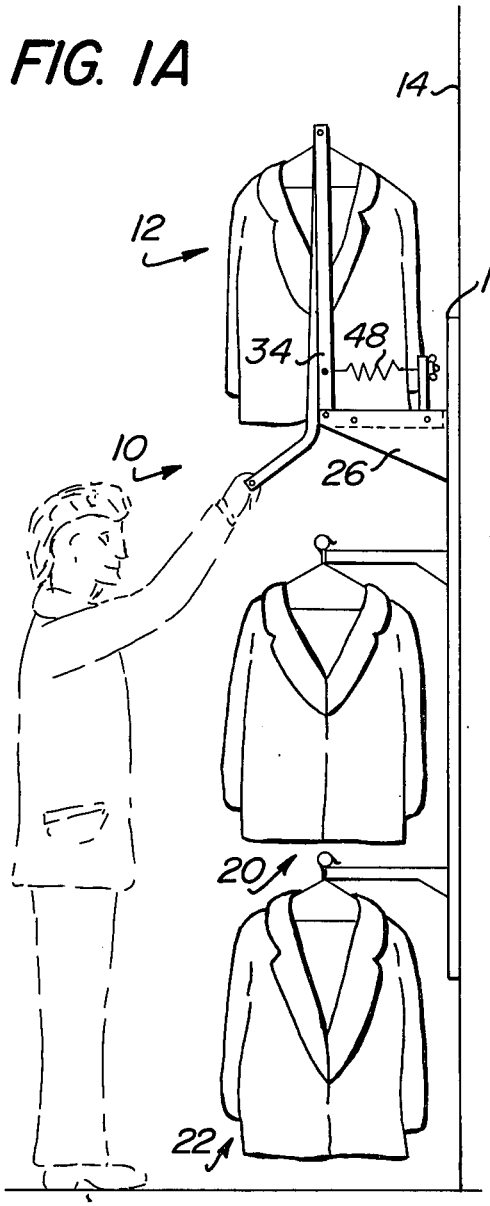
FIG. 1B
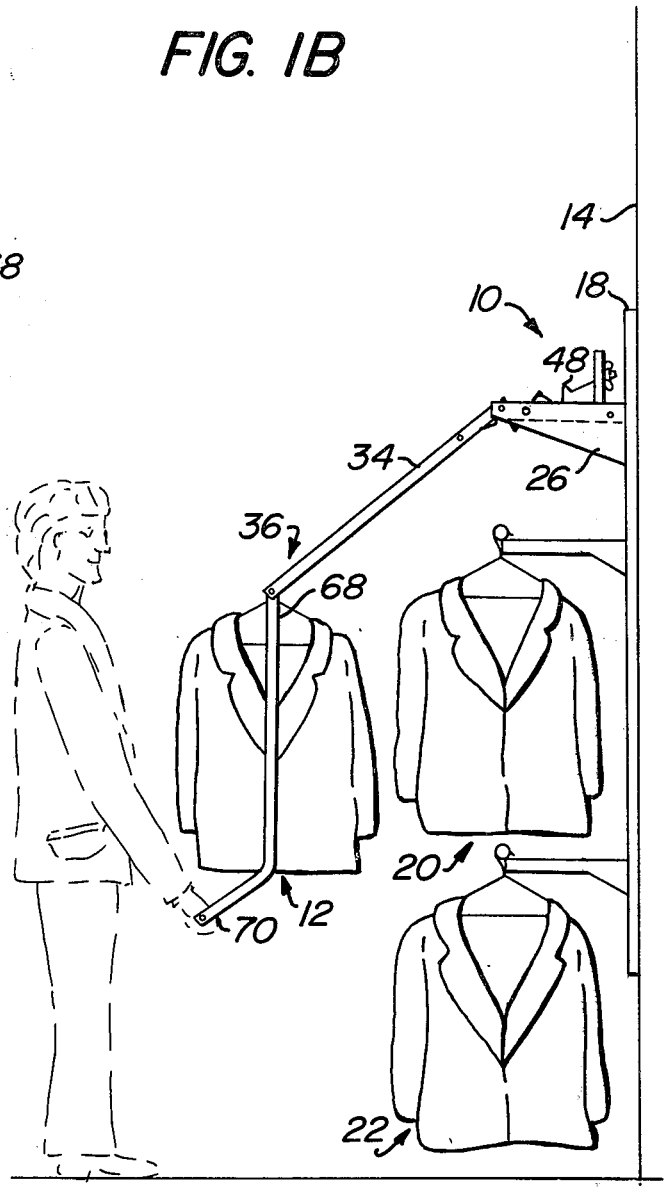
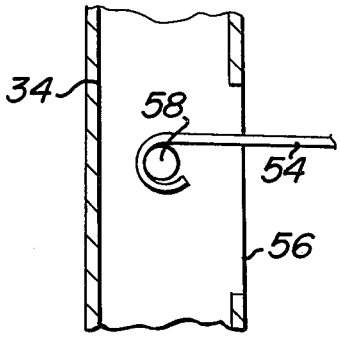
FIG. 5

FIG. 2
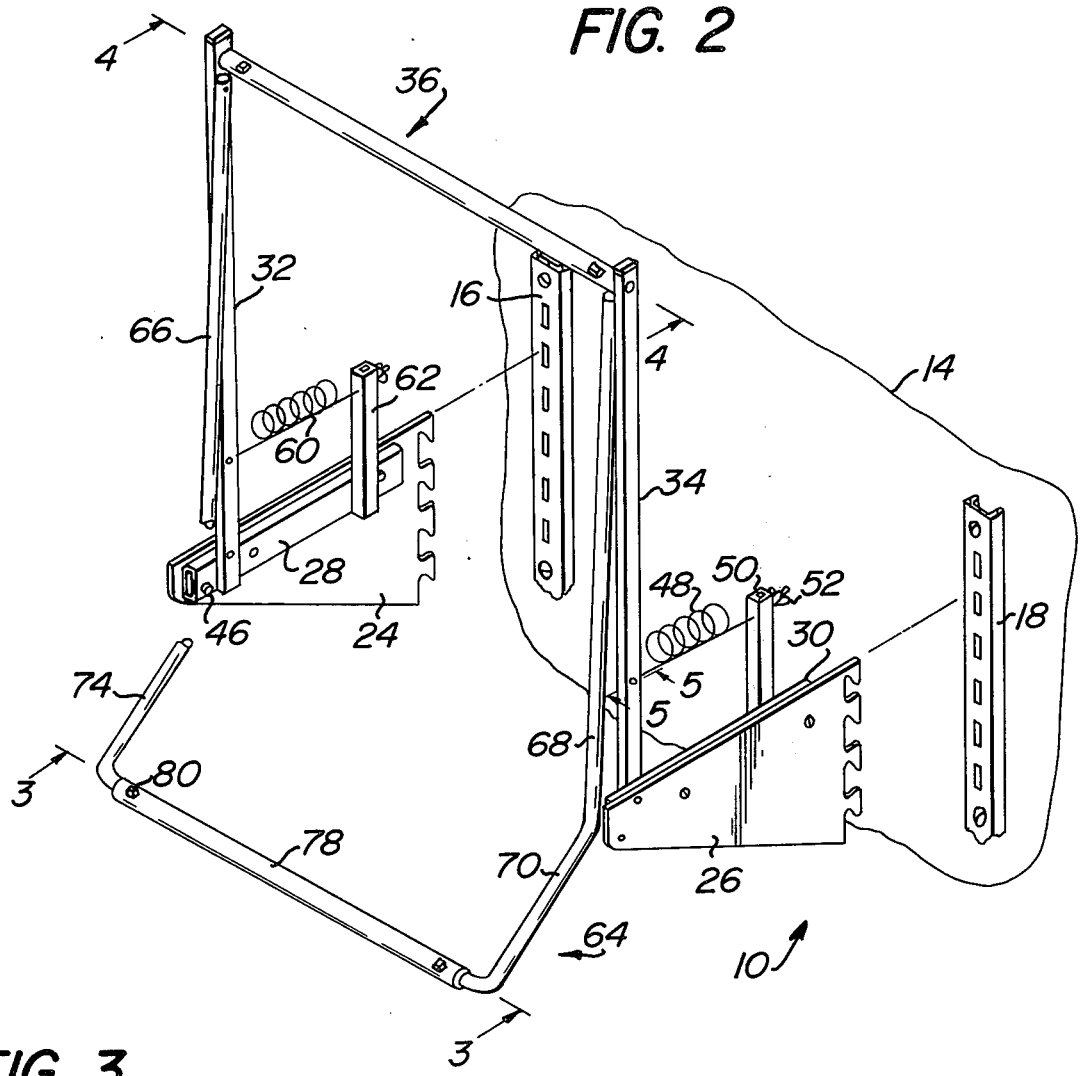
FIG. 3
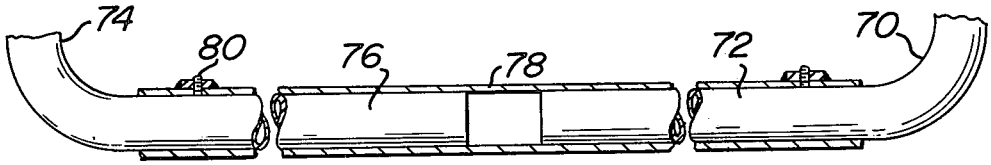
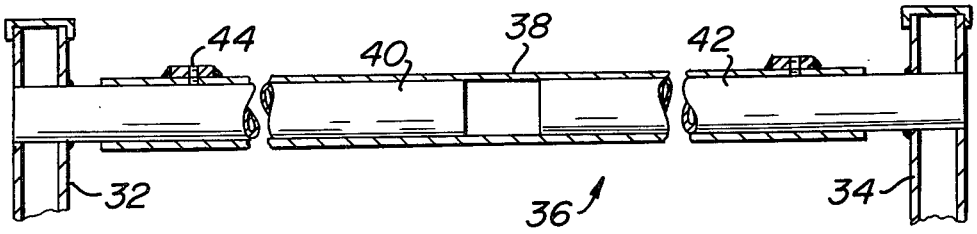
FIG. 4

HANGER

RELATED APPLICATION

This is a continuation-in-part of application Ser. No. 564,236, filed Apr. 2, 1975, and now U.S. Pat. No. 4,006,826.

BACKGROUND

Wall hangers for supporting garments and the like are known. For example, see U.S. Pat. Nos. 2,875,903 and 2,268,894. In the first mentioned patent, a garment hanger is of the type adapted to be located in a closet and thereby requires oppositely disposed side walls as well as a rear wall to support the components thereof. The second mentioned patent shows a garment hanger of the type wherein all components are on a common wall.

In prior art hangers such as that disclosed in U.S. Pat. No. 2,875,903, the device disclosed therein requires a separate detent in order to maintain the hanger rail in its lowermost access position. While said patent discloses springs for the garment rail, the springs are inoperative until the garment rail has moved to the position shown in FIG. 2 of that patent. Further, the springs do not bias the hanger to either the access position or the storage position. Hence, the garment rail in that patent may inadvertently pivot to an intermediate position. That disadvantage as well as others are overcome by the present invention.

This invention relates to an improved hanger adapted to be supported by brackets projecting from a vertical wall for enlarging the capacity of the storage area in a store or the like. The hanger includes a pair of spaced, parallel mounting brackets for supporting a hanger. A hanger device including a hanger rail is coupled to the brackets by a pair of arms. Each arm has an upper end connected to the hanger rail and a lower end pivotably connected to one of said brackets.

A pull-down bar is pivotably coupled to the hanger device between said arms for pivoting said arms to thereby lower the elevation of the hanger rail. Compression means are coupled to at least one of said arms for maintaining the hanger rail in its upper storage position. A limit stop on at least one of the brackets maintains the hanger rail in its lower access position. The compression means help to return the hanger to its upper storage position and are preferably adjustable to the customer's specifications.

An advantage of the present invention is to provide a novel hanger for increasing the capacity of a storage area wherein a rail will have an upper storage position and a lower access position while at all times being parallel to the adjacent wall from which it is supported.

Another advantage of the invention is to provide a garment hanger having an upper storage position and a lower access position which includes a gas spring arrangement whereby the garment rail is maintained in each of its positions.

Other advantages appear hereinafter.

For the purpose of illustrating the invention, there is shown in the drawings a form which is presently preferred; it being understood, however, that this invention is not limited to the precise arrangements and instrumentalities shown.

FIG. 1A is a side elevation view of a garment hanger in its upper storage position.

FIG. 1B is a side elevation view of the garment hanger in its lower access position.

FIG. 2 is an exploded perspective view of the garment hanger in FIGS. 1A and 1B.

FIG. 3 is a sectional view taken along the line 3—3 in FIG. 2.

FIG. 4 is a sectional view taken along the line 4—4 in FIG. 2.

FIG. 5 is a sectional view taken along the line 5—5 in FIG. 2.

Figure 6A:
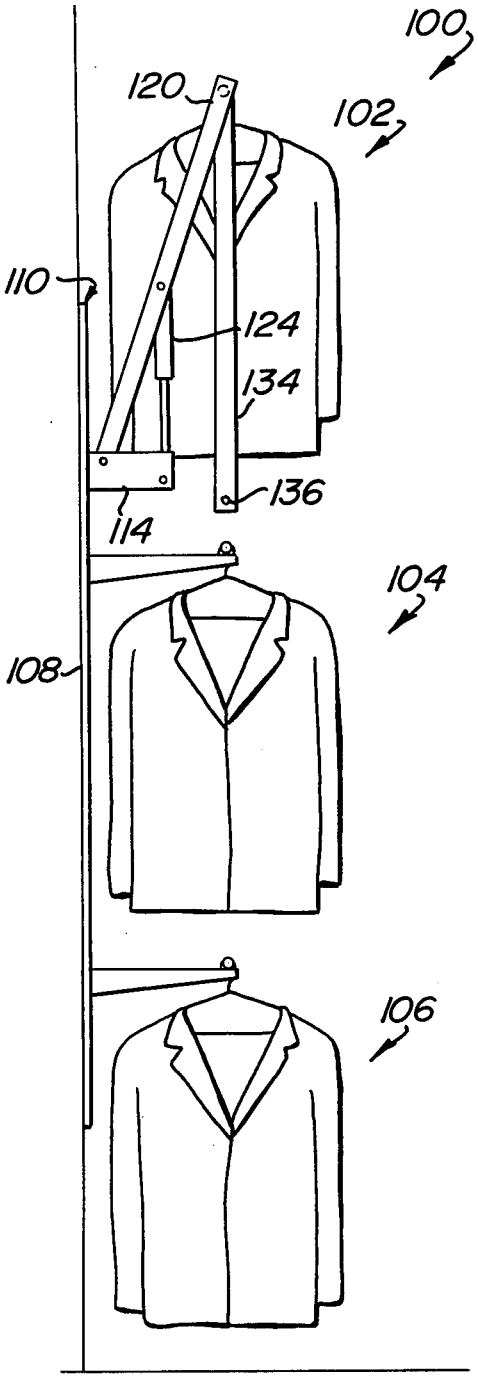
FIG. 6A is a side elevation view of an improved garment hanger of the present invention in its upper storage position.

Referring to the drawings in detail, wherein like numerals indicate like elements, there is shown in FIGS 1A and 1B a garment hanger designated generally as 10. The garment hanger 10 is adapted to increase the garment storage area above that which is normally provided in a retail garment store above the racks of garments 20 and 22 supported by wall 14.

The garment hanger 10 is adapted to support a rack of garments 12 so that each garment is generally perpendicular to the wall 14. Mounting structure 16 and 18 is attached to the wall 14. Such mounting structure may be in the form of elongated strips as shown. See FIG. 2. The racks of garment 20 and 22 are also supported by the structures 16 and 18.

The garment hanger 10 includes a pair of mounting brackets 24 and 26. See FIG. 2. The brackets 24 and 26 may be generally truncated with prongs at one end adapted to be removably inserted into elongated slots in the structure 16 and 18. In this manner, the brackets 24 and 26 may be adjustably and removably coupled to the structure 16 and 18 at the desired elevation.

A support member 28 is secured to the inner face of bracket 24. A similar support member 30 is secured to the inner face of bracket 26. The lower end of a vertically disposed arm 32 as shown in FIG. 2 is pivotably connected to the support member 28. The lower end of a mating arm 34 is pivotably connected to the support member 30. In FIG. 2, the upper ends of the arms 32 and 34 are connected to a hanger rail 36.

As shown more clearly in FIG. 4, the hanger rail 36 includes a hollow cylindrical sleeve 38. A rod 40 has one end connected to the upper end of arm 32 and is telescoped into the sleeve 38. A rod 42 has one end connected to the upper end of arm 34 and its other end is telescoped into the sleeve 38. Sleeve 38 is removably secured to each of the rods 40, 42 by means of a set screw 44. That telescoping arrangement of the components of hanger rail 36 facilitates a range of adjustment for the width of the garment hanger 10.

A limit stop 46 on the support member 28 extends toward a similar limit stop on the support member 30. The limit stops contact the lower end of the arms 32 and 34 and limit the extent to which arms 32 and 34 may rotate in both a clockwise and counter-clockwise direction in FIG. 2. The arms 32, 34 are adapted to pivot through an angle of about 120°–130° in a counterclockwise direction in FIG. 2.

The hanger rail 36 is in its upper storage position in FIG. 2. Arm 34 is biased into contact with its limit stop on support member 30 by means of a coil spring 48. Spring 48 has one end which extends through an upright post 50 on the support member 30. The free end of the wire of spring 48 is threaded and receives a manually adjustable wing nut 52 for adjusting the tension of the spring 48. The other end of spring 48 is designated as 54 in FIG. 5 and extends through a slot 46 in the arm 34 for securement to the pin 58. Spring 48 biases the arm 34 to the upright position against its limit stop as shown in FIG. 2.

A spring 60 extends between arm 32 and post 62 on the support member 28 in the same manner as described above. Hence, arm 32 is biased by the spring 60 in a clockwise direction of FIG. 2 against the limit stop 46.

A handle designated generally as 64 is provided to pivot the hanger rail 36 from its upper storage position as shown in FIGS. 1A and 2 to the lower access position shown in FIG. 1B. The handle 64 includes struts 66 and 68. Strut 66 has its upper end pivotably connected to the arm 32 adjacent the hanger rail 36. Strut 68 has its upper end connected to the arm 34 adjacent hanger rail 36. Strut 68 has an angled portion 70 and strut 66 has an angled portion 74.

Strut 68 and its angled portion 70 form an angle of about 130°. Angled portion 70 terminates in an end portion 72 which is parallel to the hanger rail 36. Angled portion 74 forms an angle of about 130° with strut 66. Portion 74 terminates in an end portion 76 which is parallel to hanger rail 36 and aligned with portion 72.

The portions 72 and 76 telescope into a hollow cylindrical sleeve 78 which is the bight portion of the U-shaped handle 64. Sleeve 78 is adjustably secured to each of the portions 72, 76 by a set screw 80. In this manner, the handle may be adjusted to various widths corresponding to the length of the hanger rail 36.

When the hanger rail 36 is in its upper storage position as shown in FIGS. 1A and 2, it is biased to the position by the coil springs 48, 60. When the hanger rail 36 is in its lower access position as shown in FIG. 1B, it is biased into remaining in that position by the coil springs 48 and 60 due to the over the center arrangement wherein the longitudinal axes of the coil springs 48, 60 lie along lines which interesect or pass below the axis of rotation for the arms 32, 34. Hence, the hanger rail 36 will remain in the position shown in FIG. 1B until raised slightly by pushing up on handle 64. Thereafter, the springs 48, 60 will return the haner rail 36 to its upper storage position as shown in FIGS. 1A and 2.

The struts 66, 68 are on the inner face of the arms 32, 34 respectively to prevent any garments supported by the rail 36 from being entangled between the arms and the handle during operation. The wind nuts 52 enable the tension of the springs 48, 60 to be adjusted in relation to the weight of the goods supported by hanger rail 36. Installation of the garment hanger 10 does not in any way interfere with the access to the racks of garments 20, 22 while at the same time increasing the storage capacity of that area in a store or the like. It will be noted that the hanger rail 36 is parallel to the wall 14 at all times.

Figure 6B:
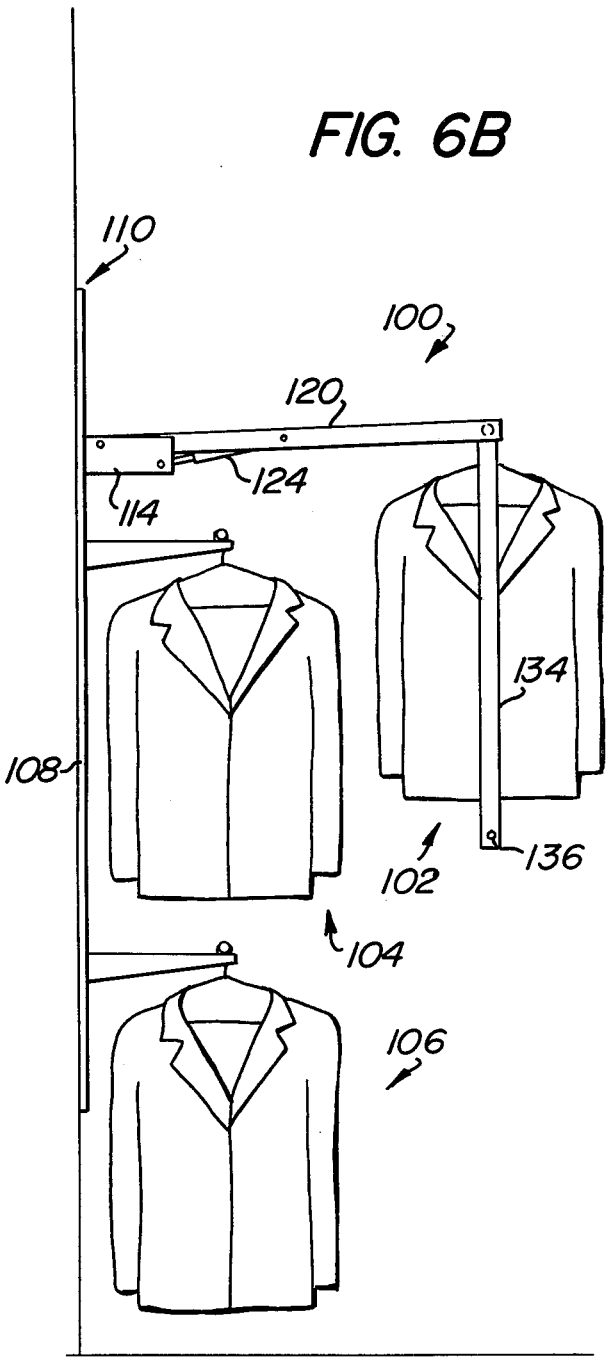
FIG. 6B is a side elevation view of the improved garment hanger in its lower access position.
Figure 8:
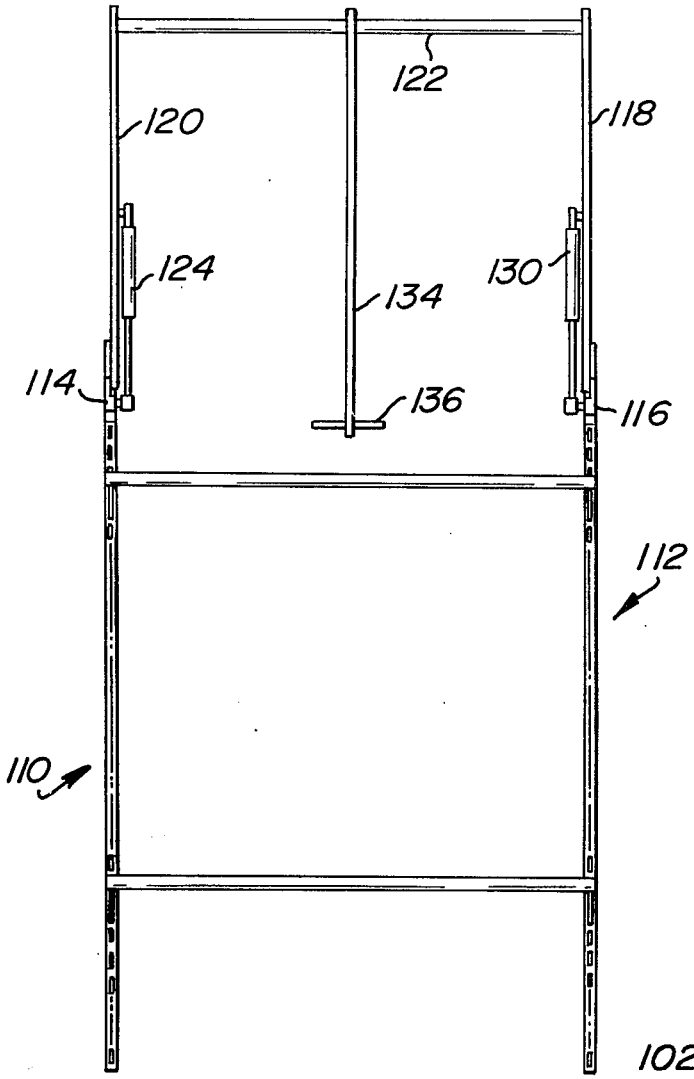
FIG. 8 is a front view of the improved garment hanger in its upper storage position in FIG. 6A.

Referring to FIGS. 6A and 6B, there is shown an improved garment hanger in accordance with the present invention designated generally as 100. The garment hanger 100 is adapted to increase the garment storage area above that which is normally provided in a retail garment store above the racks of garments 104 and 106 supported by wall 108.

The garment hanger 100 is adapted to support a rack of garments 102 so that each garment is generally perpendicular to the wall 108. Mounting structure 110 and 112 is attached to the wall 108. Such mounting structure may be in the form of elongated strips as shown. See FIG. 7. The racks of garments 104 and 106 are also supported by the structures 110 and 112.

The garment hanger 100 includes a pair of mounting brackets 114 and 116. See FIG. 7. The brackets 114 and 116 may be generally truncated with prongs at one end adapted to be removably inserted into elongated slots in the structure 110 and 112. In this manner, the brackets 114 and 116 may be adjustably and removably coupled to the structure 110 and 112 at the desired elevation.

Figure 7:
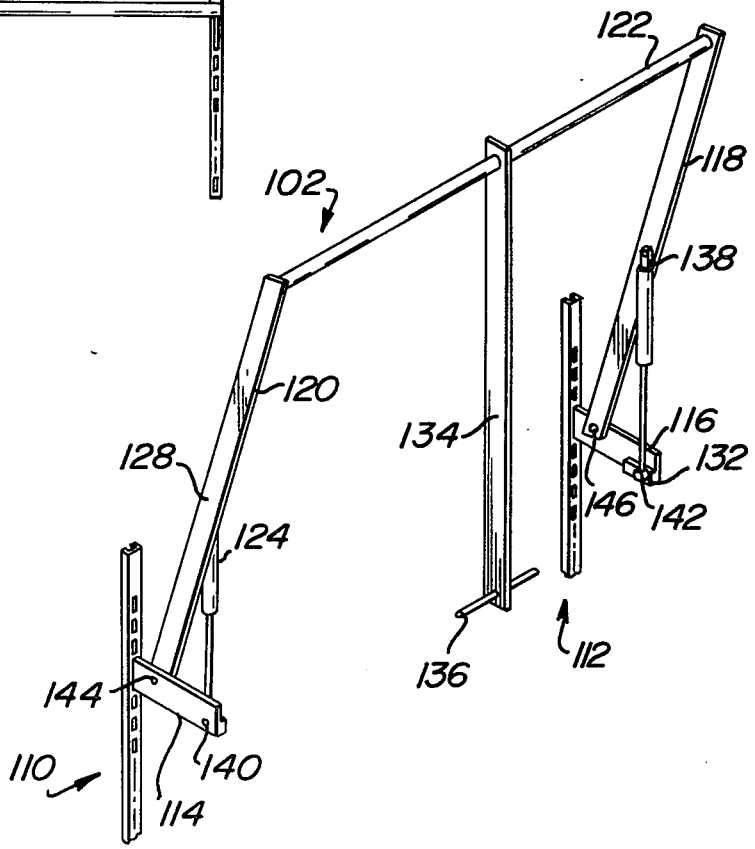
FIG. 7 is a perspective view of the improved garment hanger in FIGS. 6A and 6B.

The lower end of a substantially vertically disposed arm 118 as shown in FIG. 7 is pivotably connected to the bracket 116. The lower end of a mating arm 120 is pivotably connected to the bracket 114. In FIG. 7, the upper ends of the arms 118 and 120 are connected to a hanger rail 122.

The hanger rail 122 may include a hollow cylindrical sleeve into which rods connected to the arms 120 and 122 can telescope as previously described. The sleeve may be removably secured to each of the rods by means of a set screw as previously described. The telescoping arrangement of the components of the hanger rail 122 would facilitate a range of adjustment for the width of the garment hanger 100.

The hanger rail 122 is in its upper storage position in FIG. 7. Arm 120 is biased to the upright position by compression means such as a gas spring 124 in a substantially fully extended state. Gas spring 124 has one end which extends from a limit stop 126 on bracket 114 to which the spring end is fastened by conventional means. The other end of spring 124 is fastened by conventional means at point 128 to arm 120. The gas spring is a well-known commercial article such as the spring manufactured by Stabilus Industrie und Handels, G.M.B.H. and can be loaded to the customer's specifications by the manufacturer.

Compression means in the form of gas spring 130 similar to gas spring 124 extends between arm 118 and limit stop 132 on bracket 116 in the same manner described above. Hence, when substantially fully extended, gas spring 130 biases the arm 118 to the upright position in FIG. 7.

A pull-down bar 134 having a handle 136 is provided to pivot the hanger rail 122 against the return force of gas springs 124 and 130 from the upper storage position as shown in FIGS. 6A and 7 to the lower access position shown in FIG. 6B. The pull-down bar is rotatably mounted on the hanger rail 122 along its center portion.

When the hanger rail 122 is in its upper storage position as shown in FIGS. 6A and 7, it is biased to the position by the gas springs 124, 130 which are substantially fully extended. When the hanger rail 122 is in its lower access position as shown in FIG. 6B, the arms 118 and 120 contact limit stops 132 and 126 on brackets 116 and 114. In the lower access position, the gas springs 124 and 130 are substantially fully compressed. The springs 124 and 130 are loaded so that, when substantially fully compressed, the moments produced by the springs on the arms 118 and 120 marginally fail to overcome the countering moment produced by the load represented by the rack of garments 102 on hanger rail 122. Hence, the hanger rail 122 will remain in the lower access position shown in FIG. 6B until raised slightly by pushing up on pull-down bar 134 to overcome the countering moment produced by the load. Thereafter, the pulldown bar may be released and the gas springs 124 and 130 will gradually extend unaided to return the hanger rail 122 to its upper storage position as shown in FIGS. 6A and 7.

From the foregoing, it should be clear that compression or shortening of the gas springs 124 and 130 occurs when the hanger rail 122 is moved from its upper storage position to the lower access position. In the lower access position, the springs 124 and 130 are substantially fully compressed and shortened.

On the other hand, expansion or extension of the springs 124 and 130 occurs when the hanger rail 122 is moved from the lower access position to the upper storage position. In the upper storage position, the gas springs are substantially fully expanded and extended.

Gas spring 124 is fastened by conventional means at one end to limit stop 126 at point 140. Gas spring 130 is fastened by conventional means at one end to limit stop 132 at point 142. Fastening points 140 and 142 are below the horizontal access extending between pivot points 144 and 146. Accordingly, when arms 118 and 120 contact limit stops 132 and 126 in the lower access position, gas springs 124 and 130 are at substantially maximum compression.

While the above description relates to an improved hanger for garments, it should be apparent that the improved hanger may be used for supporting other goods such as curtains, sheets, etc. Also, the improved hanger may be used in stores such as supermarkets or the like where there is a need to increase the storage area for display of good. In a supermarket or the like, the hanger rail 122 may support shelves for the goods or a dispenser rack for dispensing goods by a gravity feed. Any such shelves or rack would be pivotably supported by the hanger rail 122 so as to remain upright at all times.

The present invention may be embodied in other specific forms without departing from the spriit or essential attributes thereof and, accordingly, reference should be made to the appended claims, rather than to the foregoing specification as indicating the scope of the invention.

I claim:

1. A hanger comprising structure attachable to a wall for supporting mounting brackets, a pair of mounting brackets for projecting in spaced parallel cantilever relation from said structure for supporting a hanger device, a hanger device including a hanger rail coupled to said brackets by a pair of arms, each arm having an upper end connected to said hanger rail and the lower end pivotably connected to one of said brackets, a pull-down bar pivotably connected to said hanger device between said arms for pivoting said arms about a horizontal axis to thereby lower the elevation of said hanger rail while bringing said hanger rail forward of said horizontal axis, compression means pivotably connected at a first end to at least one of said arms at a first point thereon and pivotably connected at a second end to at least one of said brackets at a second point thereon forward of said horizontal axis and below the elevation of said horizontal axis for maintaining said hanger rail in an upper position when said compression means is substantially fully extended and limit means secured to at least one of said brackets above said second point for maintaining said hanger rail in a lower position at which said hanger rail is accessible and at which said compression means is substantially fully compressed and below the elevation of said horizontal axis.

2. A hanger in accordance with claim 1 wherein said pull-down bar is provided with a handle at its free end.

3. A hanger in accordance with claim 2 wherein said compression means is connected to at least one arm to assist in returning the hanger rail to its upper position.

4. A hanger for increasing the storage capacity of a display area comprising a pair of mounting brackets, means for securing one end of each bracket to a vertical wall so that the brackets are generally parallel to one another, a hanger device connected to said brackets, said device including a pair of arms, each arm having a lower end pivotably connected to one of said brackets for pivoting about a horizontal axis, said hanger device including a hanger rail connected to the upper end of said arms and disposed above the elevation of said brackets when in a storage position and substantially at the elevation of said brackets when in an access position, and compression means connected to said arms and brackets, said arms being pivotable from an upright position at which said compression means is substantially fully extended to the access position at which said compression means is substantially fully compressed.

5. A hanger for increasing the storage capacity of a display area comprising a pair of mounting brackets, means for securing one end of each bracket to a vertical wall so that the brackets are generally parallel to one another, a hanger device connected to said brackets, said device including a pair of arms, each arm having a lower end pivotably connected to one of said brackets for pivoting about a horizontal axis, said hanger device including a hanger rail connected to the upper end of said arms and disposed above the elevation of said brackets when in a storage position and substantially at the elevation of said brackets when in a lower access position at which said hanger rail is accessible, and compression means pivotably connected to said arms and brackets, said arms being pivotable about said horizontal axis from an upright position at which said compression means is substantially fully extended and at which at least a portion of said compression means is above the elevation of said horizontal axis to the access position at which said compression means is substantially fully compressed and below the elevation of said horizontal axis.

6. A hanger in accordance with claim 5 including a limit stop on at least one bracket for contact with one of said arms to define the access psoition of said one arm.

* * * * *